US007050730B2

(12) United States Patent
Sasai

(10) Patent No.: US 7,050,730 B2
(45) Date of Patent: May 23, 2006

(54) IMAGE FORMING APPARATUS WITH CONTROLLER THAT APPLIES PRELIMINARY TRANSFER BIAS TO TRANSFER MEMBER BASED ON PRINT WORKLOAD

(75) Inventor: Takahiro Sasai, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 10/382,167

(22) Filed: Mar. 5, 2003

(65) Prior Publication Data

US 2003/0156852 A1 Aug. 21, 2003

Related U.S. Application Data

(63) Continuation of application No. 10/083,881, filed on Feb. 26, 2002, now Pat. No. 6,584,292.

(30) Foreign Application Priority Data

Mar. 6, 2001 (JP) ..... 2001-061032

(51) Int. Cl.
*G03G 15/16* (2006.01)
*G03G 15/30* (2006.01)

(52) U.S. Cl. ..... 399/44; 399/66; 399/149

(58) Field of Classification Search ..... 399/66, 399/314, 296, 297
See application file for complete search history.

(56) References Cited

U.S. PATENT DOCUMENTS

| | | | | |
|---|---|---|---|---|
| 5,227,851 | A | 7/1993 | Yoshida et al. | 399/18 |
| 5,832,336 | A | 11/1998 | Kawasaki et al. | 399/71 |
| 6,047,144 | A * | 4/2000 | Sasai et al. | 399/44 |
| 6,192,203 | B1 * | 2/2001 | Nishio et al. | 399/44 |
| 6,434,344 | B1 * | 8/2002 | Yoshida et al. | 399/44 |

FOREIGN PATENT DOCUMENTS

| | | |
|---|---|---|
| JP | 5-165378 | 7/1993 |
| JP | 05-313431 | 11/1993 |
| JP | 07-064444 | 3/1995 |
| JP | 7-072774 | 3/1995 |
| JP | 07-147614 | 6/1995 |
| JP | 08-095453 | 4/1996 |
| JP | 08-098043 | 4/1996 |
| JP | 08211760 A * | 8/1996 |

(Continued)

*Primary Examiner*—Quana Grainger
(74) *Attorney, Agent, or Firm*—Hogan & Hartson, L.L.P.

(57) ABSTRACT

A cleaner-less image former that can prevent cleaning efficiency from reducing and maintain high print quality. After a printing process is started, one lookup table LUT is selected from a group of LUTs based on a temperature detected by a temperature sensor and the number of sheets of paper which have been printed. A pre-transfer bias is determined by applying a current value memorized in a feedback current value memorizing part to the selected LUT, the determined pre-transfer bias is applied to a transfer roller, and then a transfer bias is determined based on the above current value and the temperature. The determined transfer bias is applied to the transfer roller. The residual toner remaining on the transfer roller, a charge brush and a memory removal brush is removed by applying the pre-transfer bias.

13 Claims, 10 Drawing Sheets

FOREIGN PATENT DOCUMENTS

| | | |
|---|---|---|
| JP | 09-080937 | 3/1997 |
| JP | 10-161500 | 6/1998 |
| JP | 10-301407 | 11/1998 |
| JP | 10-339986 | 12/1998 |
| JP | 11-007211 | 1/1999 |
| JP | 11-109689 | 4/1999 |
| JP | 11-161052 | 6/1999 |
| JP | 2000-075694 | 3/2000 |
| JP | 2001-013836 | 1/2001 |
| JP | 2001-027836 | 1/2001 |

* cited by examiner

IMAGE FORMING APPARATUS WITH CONTROLLER THAT APPLIES PRELIMINARY TRANSFER BIAS TO TRANSFER MEMBER BASED ON PRINT WORKLOAD

This is a continuation of application Ser. No. 10/083,881 filed Feb. 26, 2002, now U.S. Pat. No. 6,584,292 which application is hereby incorporated by reference in its entirety.

CROSS REFERENCES TO RELATED APPLICATIONS

This application claims priority under 35 USC 119 of Japanese Patent Application No. 2001-61032 filed in JPO on Mar. 6, 2001, the entire disclosure of which is incorporated herein by reference.

BACKGROUND OF THE INVENTION

1. Field of the Invention

The present invention relates to a cleaner-less type image forming apparatus and method (hereafter called a cleaner-less image forming apparatus) that can prevent cleaning efficiency from reducing and maintain high print quality.

2. Description of the Related Art

A transfer roller, a charge brush, and a memory removal brush are made to contact with a photoconductive body in the cleaner-less image forming apparatus adopting a contact transferring method. A sheet of paper is carried with the sheet sandwiched in between the transfer roller and the photoconductive body, and at this time, a toner image formed on the photoconductive body is transferred to the sheet by applying a predetermined bias to the transfer roller.

The charge brush and the memory removal brush are obviously more contaminated or stained as the number of sheets of paper which have been printed grows. For this reason, a transfer bias is preliminarily applied to the transfer roller within an interval which is a period from the time one sheet of paper passes the transfer roller to the time the next sheet reaches the transfer roller, before printing is carried out, in order to clean these brushes.

As the brushes are more contaminated, however, the preliminarily bias voltage that is applied in a usual case cannot fully eliminate the contamination of the brushes. When using a brush charger, it is difficult to keep charge potential on a surface of the photoconductive body uniform, especially due to the toner adhered to the brush, etc. This is because the toner is made up from particles which are insulators, and an electric current between the charge brush and the surface of the photoconductive body is reduced due to the particles adhered to fibers of the charge brush.

Further, the memory removal brush cannot fully disperse the residual toner remaining on the surface of the photoconductive body as a large quantity of toner is adhered to the removal brush, and there is a problem of reducing cleaning efficiency. That is why the image of the previous page appears on the next page, i.e., a so-called memory occurs, and the residual toner on the surface of the photoconductive body is adhered to the sheet of paper, i.e., so-called fog is generated, so that there is a problem of reducing print quality. Additionally, a problem of toner on the backside of a sheet happens such that the residual toner on the surface of the photoconductive body is adhered to the transfer roller, and the toner of the transfer roller is further adhered to the backside of the sheet.

SUMMARY OF THE INVENTION

The present invention is provided in view of the above problems, and it is an object of the present invention to provide a cleaner-less image forming apparatus and method that can prevent cleaning efficiency from reducing and maintain high print quality.

In order to accomplish the aforementioned object, the image forming apparatus of the present invention includes a photoconductive body, a charge member for charging a surface of the photoconductive body, a transfer member which is disposed so as to contact with the photoconductive body and transfers a toner image on the photoconductive body to a sheet of paper, a memory removal member for dispersing residual toner remaining on the photoconductive body, and a controller for changing a preliminary bias in accordance with a print workload that the apparatus has had and applying the preliminary bias to the transfer member before applying a transfer bias to the transfer member.

With the apparatus, it is possible to prevent contamination of the photoconductive body, the transfer member, the charge member, and the memory removal member because the preliminary transfer bias is applied to the transfer member (the pre-transfer bias is applied) before applying the transfer bias to the transfer member, that is to say, before printing is carried out. Therefore, the toner can be removed from the charge member, so that the surface of the photoconductive body can be uniformly charged. Moreover, the toner can be removed also from the memory removal member, so that cleaning efficiency can be prevented from reducing. Furthermore, it is possible to prevent the toner from adhering to a surface of the transfer member, and to prevent the toner from adhering to a backside of a sheet.

According to one aspect of the present invention which is one of the greatest characteristics of the present invention, the pre-transfer bias voltage is changed in accordance with the print workload, so that the above-described effects are more improved and maintained. In other words, as the print workload increases more (for example, the accumulated number of sheets of paper which have been printed increases, or an accumulated period of time for which the photoconductive body has been being worked increases), the pre-transfer bias voltage is made to be higher, and the high cleaning efficiency is maintained. Additionally, the pre-transfer bias may be being applied to the transfer member for a period which the photoconductive body takes to rotate once or more.

Meanwhile, the pre-transfer bias is preferably changed in accordance with not only the print workload but also a surrounding condition such as a temperature or humidity because resistance of the transfer member varies in accordance with the surrounding condition. In this manner, it is possible to obtain a still more optimum pre-transfer bias voltage when printing is to be carried out.

Additional objects, aspects, benefits and advantages of the present invention will become apparent to those skilled in the art to which the present invention pertains from the subsequent detailed description and the appended claims, taken in conjunction with the accompanying drawings.

DETAILED DESCRIPTION OF THE INVENTION

Hereinafter, the present invention will be described in more detail by a preferred embodiment.

Figure 1:
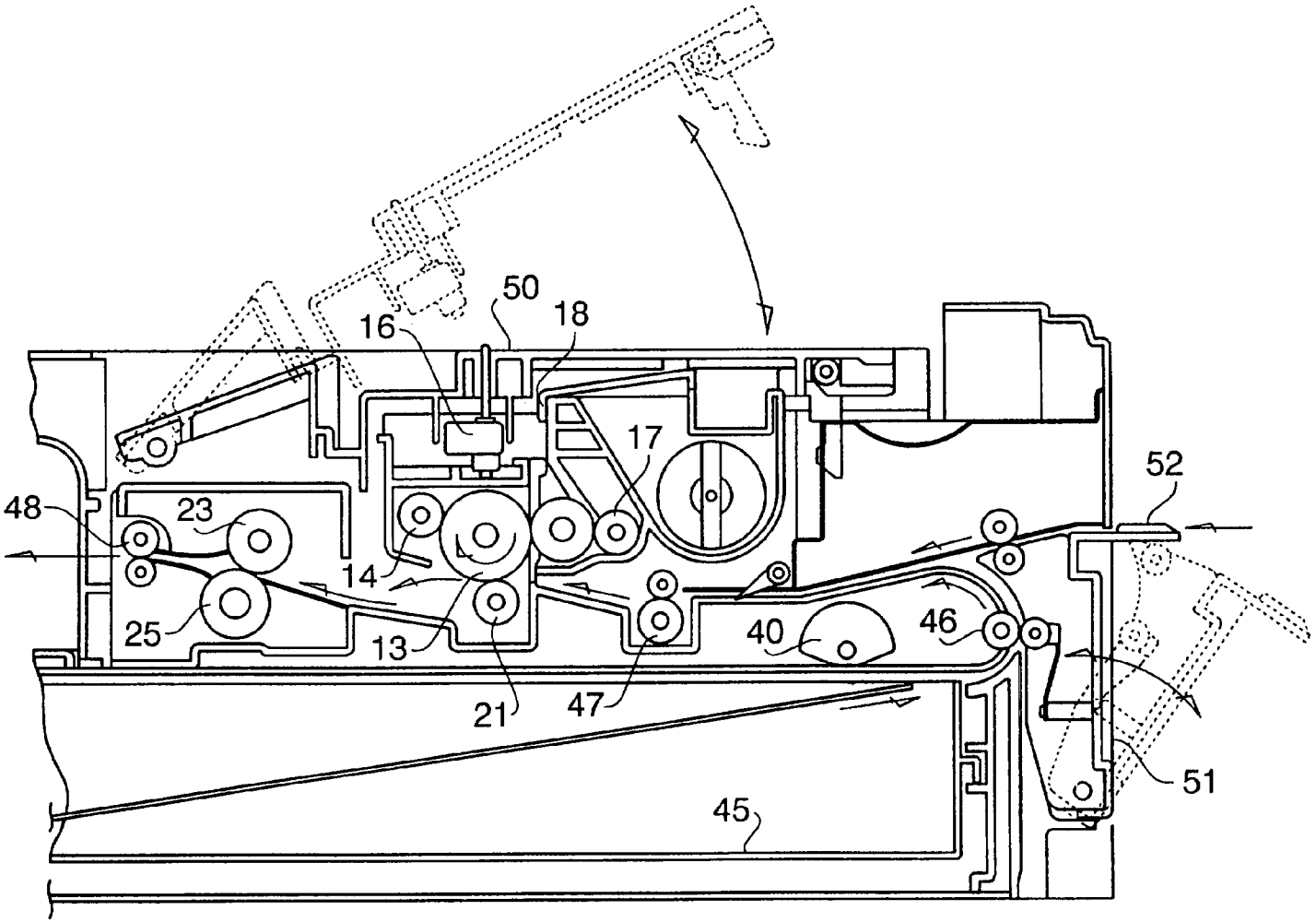
FIG. 1 is a sectional view of a main part of a recording unit of a cleaner-less image forming apparatus according to an embodiment of the present invention.

As shown in FIG. 1, which gives an outline of the structure of a recording unit of a cleaner-less image forming apparatus of an embodiment of the present invention, a pick-up roller 40, feed rollers 46, 47, a photoconductive drum 13 as a photoconductive body, a transfer roller 21 as a transfer member, a heat roller 23, a press roller 25, and an exit roller 48 are disposed along a paper carrying route from a paper cassette 45 for setting sheets of paper. The toner is supplied to the photoconductive drum 13 by a supply roller 17 and a development roller 18. Moreover, the photoconductive drum 13 is charged by a charge brush 14, and an electrostatic latent image is formed by an LED print head 16, based on image information. In addition, the photoconductive drum 13, the charge brush 14, and a memory removal brush 26 mentioned later compose one drum unit, and can be freely removed from the apparatus.

An inner cover 50 is openably installed on an upper surface of the body of the apparatus. The LED print head 16 is installed on a lower surface of the inner cover 50. When closing the inner cover 50, the LED print head 16 is disposed in a predetermined position to the photoconductive drum 13. Further, an openable cover 51 is installed on a side of the body of the apparatus. The cover 51 is provided for releasing the jam etc. of one or more sheets of paper that are carried along a U-turn path. The upper surface of the cover 51 functions as a slot 52 of a sheet of paper that is manually supplied.

A sheet of paper in the paper cassette 45 is picked up by the pick-up roller 40, and is carried by the feed rollers 46, 47. Subsequently, the sheet is fed in between the photoconductive drum 13 and the transfer roller 21, and the toner image is transferred to the sheet. The sheet to which the toner image has been transferred is discharged by the exit roller 48 after fixing the toner image when the sheet passes in between the heat roller 23 and the press roller 25.

Figure 2:
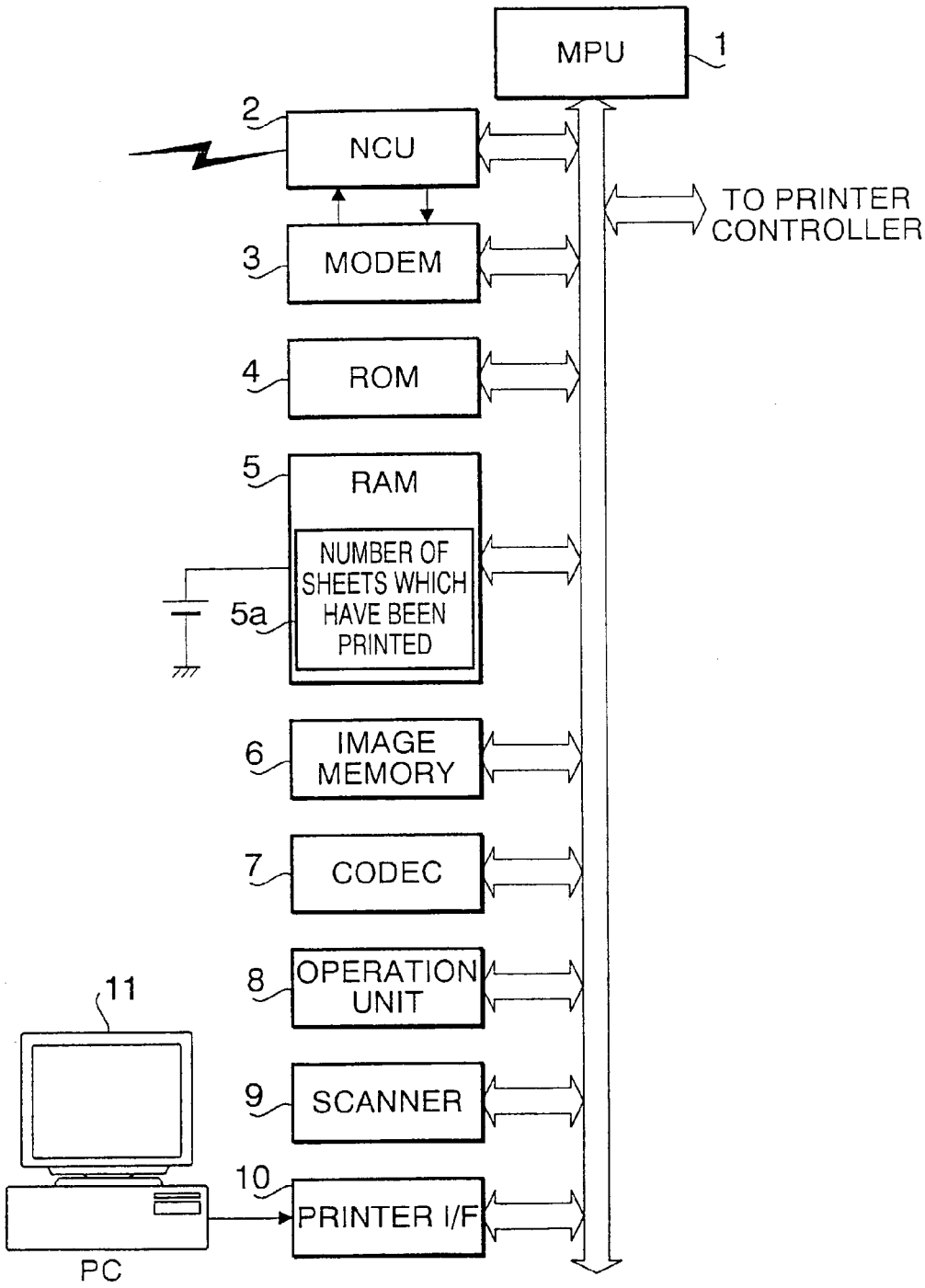
FIG. 2 is a schematic block diagram of one part of entire structure of the cleaner-less image forming apparatus of FIG. 1.

In this embodiment, the cleaner-less image forming apparatus is composed as a so-called multi-function peripheral having the facsimile function and the copy function. As shown in FIG. 2, in the apparatus, provided are a MPU 1, an NCU (Network Control Unit) 2, a MODEM 3, a ROM 4, a RAM 5, an image memory (DRAM) 6, a CODEC (Coder and Decoder) 7, an operation unit 8, a scanner 9 and a printer I/F 10 which can be connected to a personal computer 11.

The MPU 1 controls each part of the apparatus. The NCU 2 controls the connection with a public switched telephone network (PSTN), and has the function of transmitting an address signal corresponding to a telephone number (including a facsimile number) of a terminal at the other side and the function of detecting an incoming call. The MODEM 3 modulates transmission data, and demodulates reception data in accordance with V.17, V.27ter, V.29, etc. based on a facsimile transmission control procedure in accordance with T recommendation T.30 of the ITU (International Telecommunication Union). Alternatively, the apparatus modulates transmission data, and demodulates reception data in accordance with V.34 in addition to V.17, V.27ter, and V.29, etc.

The ROM 4 memorizes a program for controlling the apparatus. The RAM 5 temporarily memorizes data, etc., and has an area 5*a* for memorizing the number of how many sheets of paper have been printed by the drum unit that is currently installed. The image memory 6 temporarily memorizes received image data and image data which has been read by the scanner 9. The CODEC 7 encodes the read image data in order to send it by the MH, MR, or/and MMR methods, etc., and decodes received image data. The operation unit 8 is provided for a user to instruct the cleaner-less image forming apparatus to receive and send facsimile and to carry out printing, etc. The scanner 9 reads image data of an original document when sending facsimile.

Figure 3:
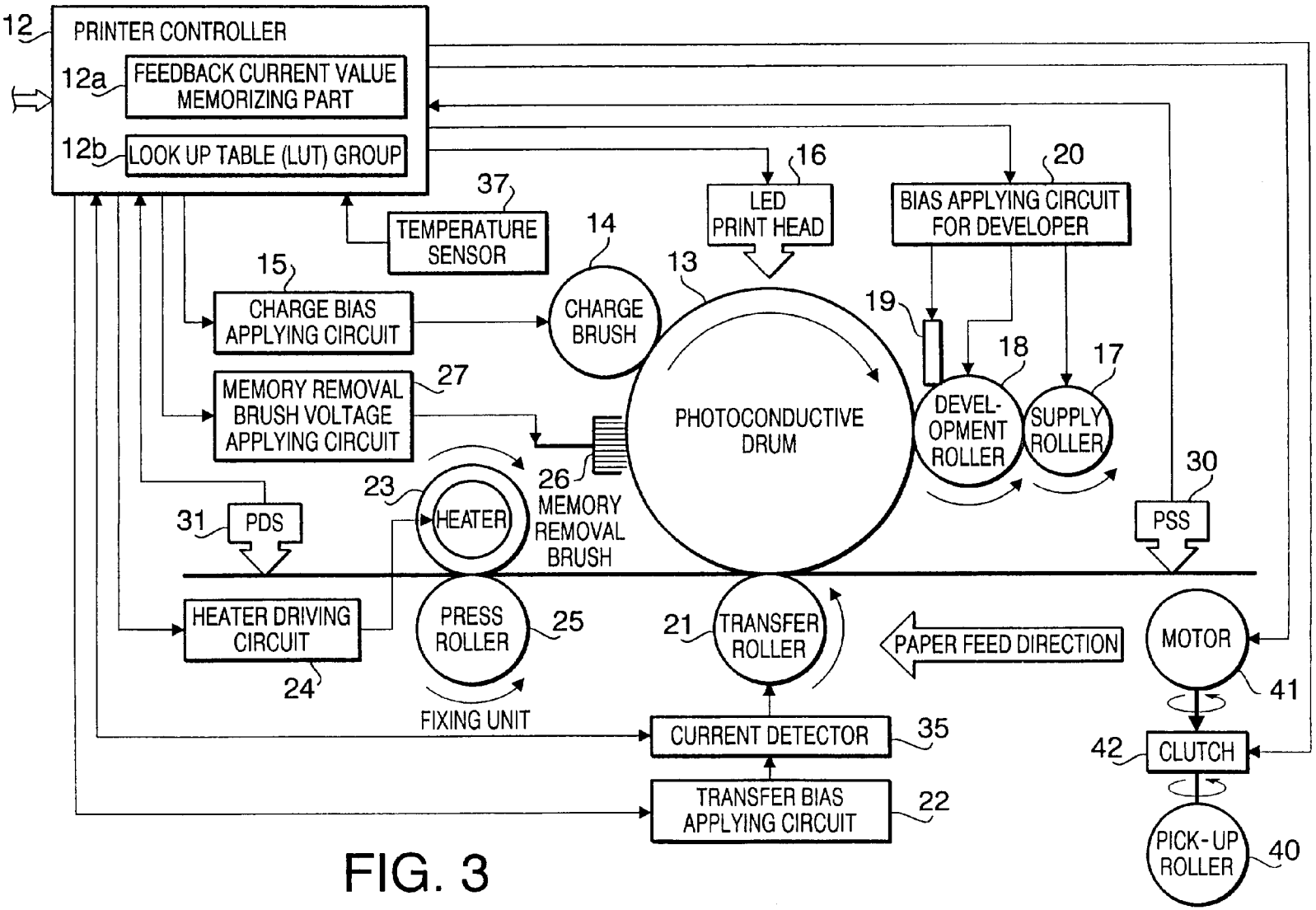
FIG. 3 is a schematic block diagram of another part of the entire structure of the cleaner-less image forming apparatus of FIG. 1.
Figure 8:
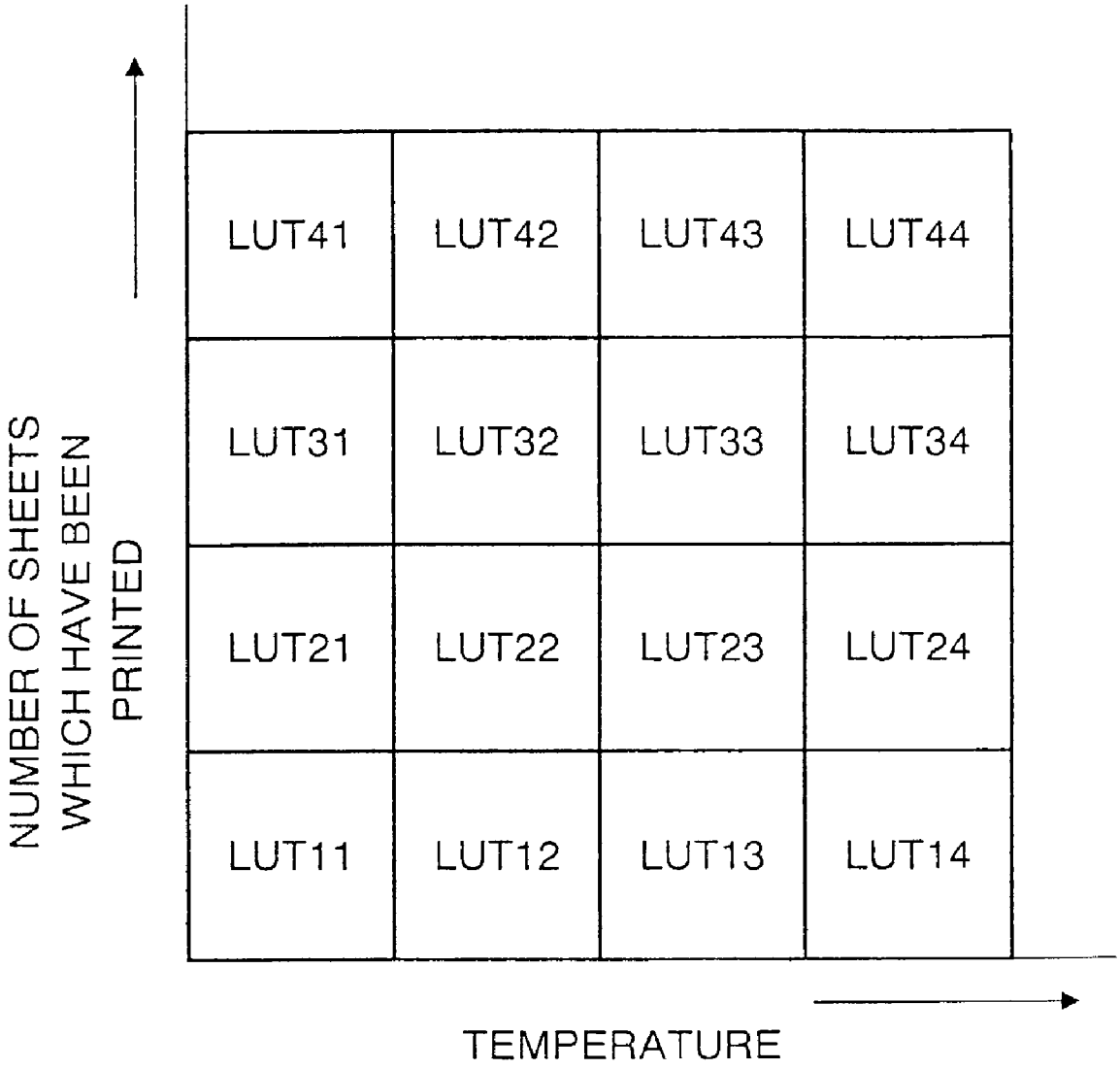
FIG. 8 is a view showing a lookup table (LUT) group which is used by the cleaner-less image forming apparatus of FIG. 1, and is divided into a plurality of lookup tables (LUTs) in accordance with various values of a temperature and various values of the number of sheets of paper which have been printed.

As shown in FIG. 3, a printer of the apparatus has a printer controller 12 for controlling each part of the printer. The printer controller 12 has a feedback current value memorizing part 12*a* for memorizing a value of an electric current caused by a test voltage applied to the transfer roller 21 during a stand-by period, and has a lookup table (LUT) group 12*b*. As illustrated in FIG. 8, for example, the lookup table (LUT) group 12*b* is divided into a plurality of sections (here, 16 LUTs) in accordance with various values of a temperature and various values of the number of sheets of paper which have been printed, and one of a plurality of LUTs is selected depending on a temperature and the number of sheets of paper which have been printed when determining a pre-transfer bias. The one selected lookup table corresponds to the print workload and the surrounding condition (in this example, the print workload is the number of sheets which have been printed, and the surrounding condition is a temperature).

In other words, when determining the bias voltage to be preliminarily applied to the transfer roller 21 before printing is carried out, the electric current value memorized in the feedback current value memorizing part 12*a* is applied to the LUT which is selected from the lookup table (LUT) group 12*b*, and the pre-transfer bias voltage is determined.

The photoconductive drum 13 whose outer circumferential surface is coated by an organic photo conductor is disposed as a photoconductive body inside the printer, and the photoconductive drum 13 is rotated by a driving unit (not shown). The charge brush 14 is disposed, as a brush roller type charger, at a position around the photoconductive drum 13, and a predetermined bias voltage is applied to the charge brush 14 by a charge bias applying circuit 15. The charge brush 14 to which the bias voltage is applied charges the outer circumferential surface of the photoconductive drum 13 uniformly at about −750 V with the photoconductive drum rotating.

The LED print head 16 as an exposing unit which is disposed at a position around the photoconductive drum 13 is provided with multiple arranged LEDs, emits light to the outer circumferential surface of the photoconductive drum 13 based on input image information, and forms, on the surface of the photoconductive drum 13, an electrostatic latent image corresponding to the image information.

Further, the developer disposed at a position around the photoconductive drum 13 includes the supply roller 17, the development roller 18, a blade 19, and a bias applying circuit 20 for the developer. The supply roller 17 supplies the toner to the development roller 18 with the toner charged from a toner case (not shown) which includes the toner. A predetermined bias voltage (−700V to −600V, preferably about −650V) is applied to the supply roller 17 by the bias applying circuit 20. By the bias applying circuit 20 for the developer, a predetermined bias voltage (−400V to −300V, preferably −350V) is applied to the development roller 18 disposed in contact with the supply roller 17 and the photoconductive drum 13.

The blade 19 elastically contacts with the outer circumferential surface of the development roller 18, causes a layer thickness of the toner adhered to the outer circumferential surface of the development roller 18 to be uniform, and a predetermined bias voltage (−700V to −600V, preferably about −650V) is applied to the blade 19 by the bias applying circuit 20.

Further, the transfer roller 21 as a transfer unit is disposed at a position around the photoconductive drum 13 so as to sandwich the paper carrying route in cooperation with the photoconductive drum and to contact with the outer circumferential surface of the photoconductive drum 13. The transfer roller 21 is rotated by a driving unit (not shown). A predetermined bias voltage is applied to the transfer roller 21 by a transfer bias applying circuit 22. An electric current of the transfer roller 21 is detected by a current detector 35, and the detected current value is memorized by the feedback current value memorizing part 12*a* of the printer controller 12.

When applying a pre-transfer bias to the transfer roller 21 before printing is carried out, the printer controller 12 determines the pre-transfer bias voltage by applying the electric current value memorized in the feedback current value memorizing part 12*a* to one lookup table (LUT) selected from the group 12*b* of LUTs. In this manner, the transfer bias applying circuit 22 applies the determined pre-transfer bias voltage to the transfer roller 21. The printer controller 12 also determines a transfer bias based on the current value memorized in the feedback current value memorizing part 12*a* and a temperature obtained by a temperature sensor 37, and the transfer bias applying circuit 22 applies the determined transfer bias to the transfer roller 21 when printing is carried out.

A fixing unit disposed at a downstream side of the transfer roller 21 in the paper carrying route comprises the heat roller 23 having a heater such as a halogen lamp, and comprises a heater driving circuit 24, the press roller 25, etc. The heater of the heat roller 23 is heated to a predetermined temperature by the heater driving circuit 24. The heat roller 23 and the press roller 25 fix the toner image on the sheet by heating and pressuring the sheet after the transfer roller 21 carries out transferring to the sheet.

In the apparatus, the memory removal brush 26 is disposed at a position around the photoconductive drum 13. The memory removal brush 26 is provided for removing the residual toner image (the memory image) which remains along the outline or contour of the image on the outer circumferential surface of the photoconductive drum 13 even after transferring is carried out. A predetermined bias voltage is applied to the memory removal brush 26 by a voltage applying circuit 27 for the memory removal brush.

Furthermore, in the paper carrying route of the apparatus, a PSS (Paper Supply Sensor) 30 as a sensor for detecting whether or not the sheet has been sent from the paper cassette 45 (refer to FIG. 1) is disposed at an upstream side of the photoconductive drum 13 and the transfer roller 21. In addition to that, a PDS (Paper Discharge Sensor) 31 is disposed as a sensor for detecting whether or not the sheet which has undergone transferring and fixing has been sent to the downstream side of the heat roller 23 and the press roller 25. As also described in a printing procedure mentioned later, the PSS 30 is turned ON when a sheet of paper is supplied from the paper cassette 45, and the PDS 31 is turned ON when the sheet of paper which has undergone transferring and fixing is sent.

At a paper feeding side, the paper feeding mechanism is provided for picking up a sheet of paper set in the paper cassette 45 one by one. In the paper feeding mechanism, the pick-up roller 40 and a motor 41 can be connected to each other through a clutch 42. When a sheet of paper is picked up from the paper cassette 45, the pick-up roller 40 is connected to the motor 41 by the clutch 42, and the sheet in the paper cassette 45 is picked up one by one by rotating the pick-up roller 40.

In the cleaner-less image forming apparatus composed as described above, the print working is well known. An outline of the print working is, however, given as follows. The photoconductive drum 13 is uniformly charged at about −750 V by the charge brush 14, and an electrostatic latent image corresponding to image information is formed on the charged photoconductive drum 13 by the LED print head 16. The toner is adhered to the electrostatic latent image on the photoconductive drum 13 by the development roller 18, and the toner image is formed on the photoconductive drum 13. After that, the toner image on the photoconductive drum 13 is transferred to the sheet by the transfer roller 21. The sheet which has undergone transferring is heated and pressured by the heat roller 23 and the press roller 25, and the toner image is fixed to the sheet as a permanent image.

In this embodiment, the apparatus is composed so as to remove the residual toner which remains on the photoconductive drum 13, the charge brush 14, the transfer roller 21, and the memory removal brush 26 by applying the pre-transfer bias to the transfer roller 21 before printing is carried out. The apparatus is characterized in that the pre-transfer bias is changed in accordance with the number of how many sheets of paper have been printed, that is to say, the pre-transfer bias becomes higher as the number of sheets of paper which have been printed increases.

Figure 5:
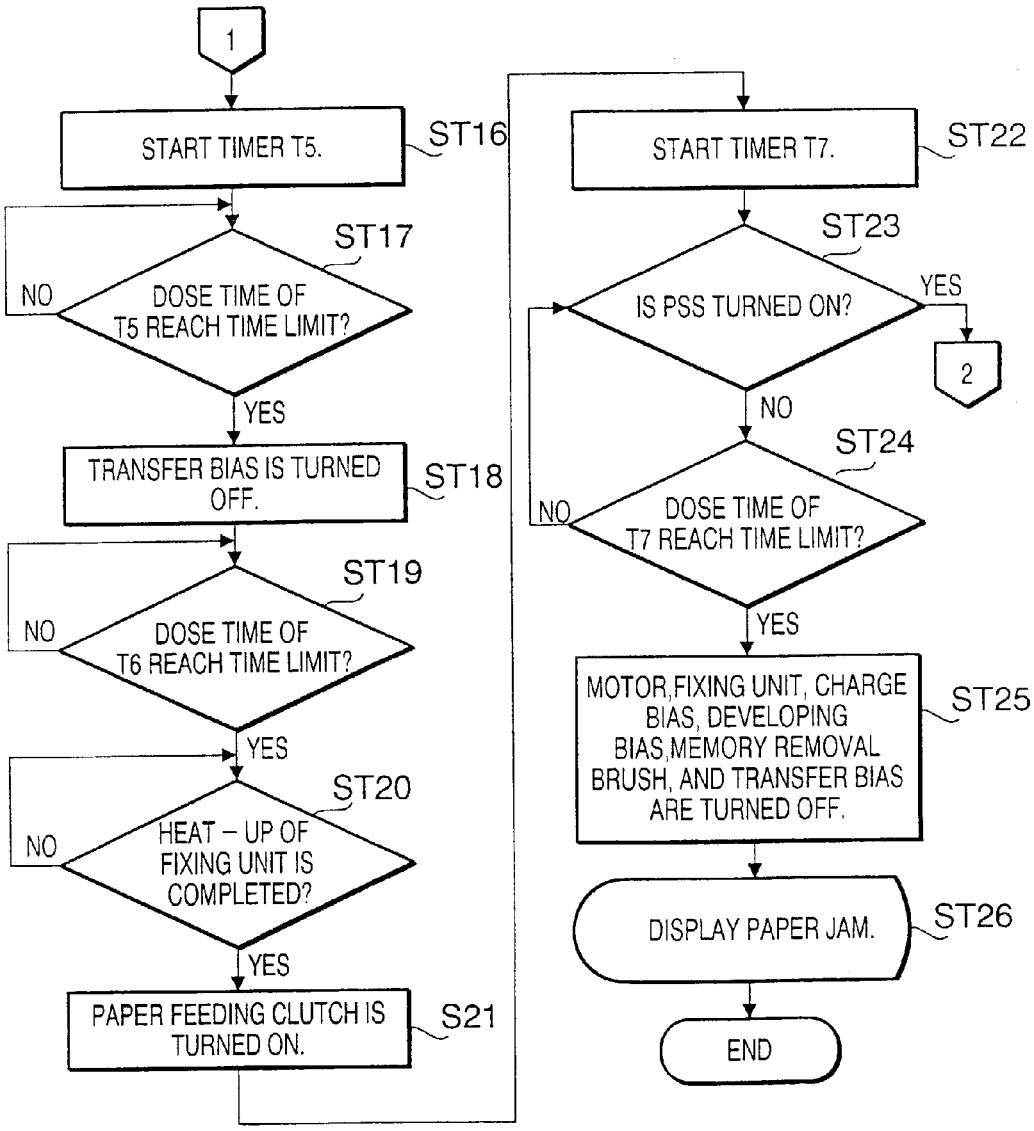
FIG. 5 is a flowchart following the flowchart of FIG. 4.
Figure 6:
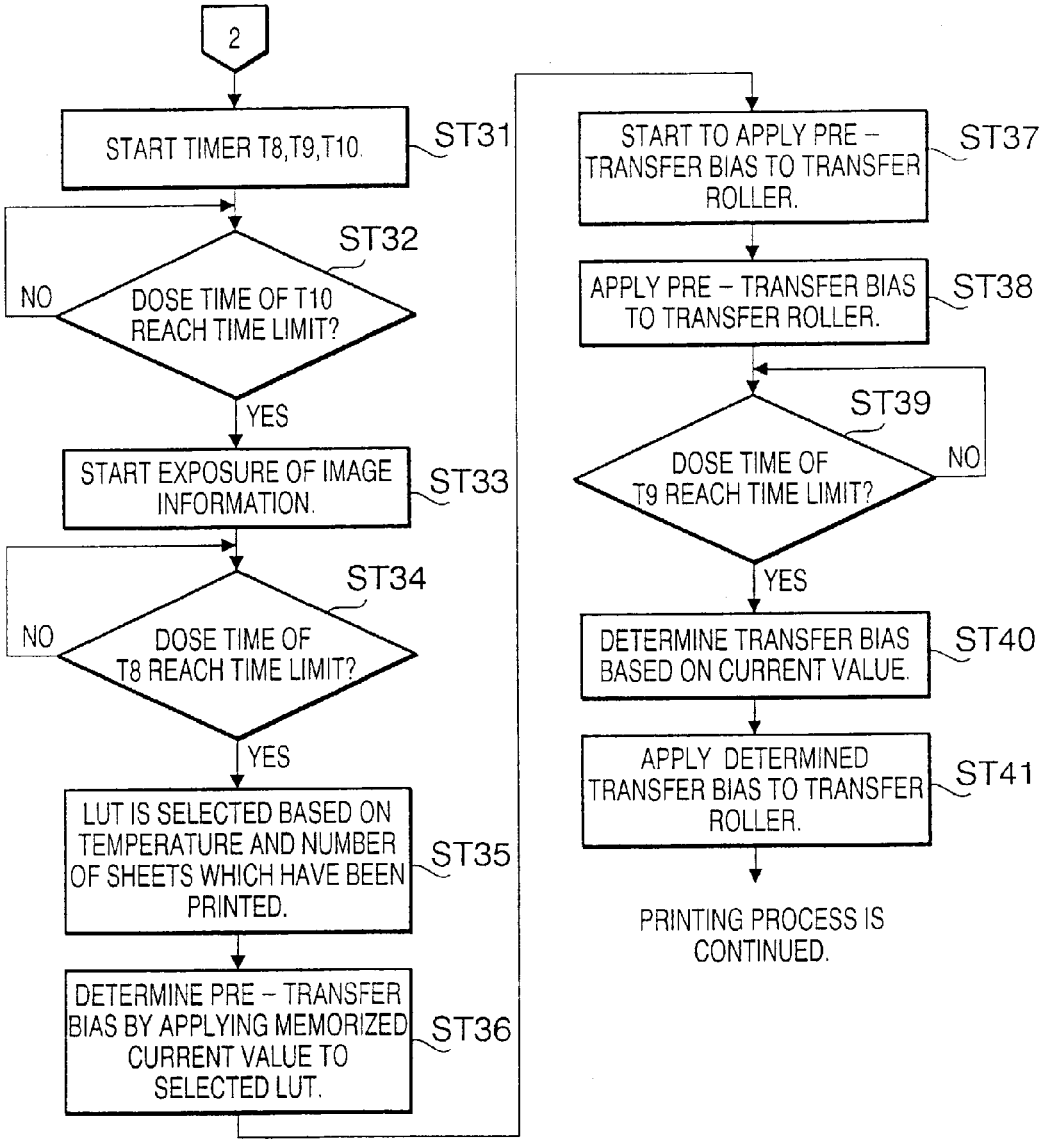
FIG. 6 is a flowchart following the flowchart of FIG. 5.
Figure 7:
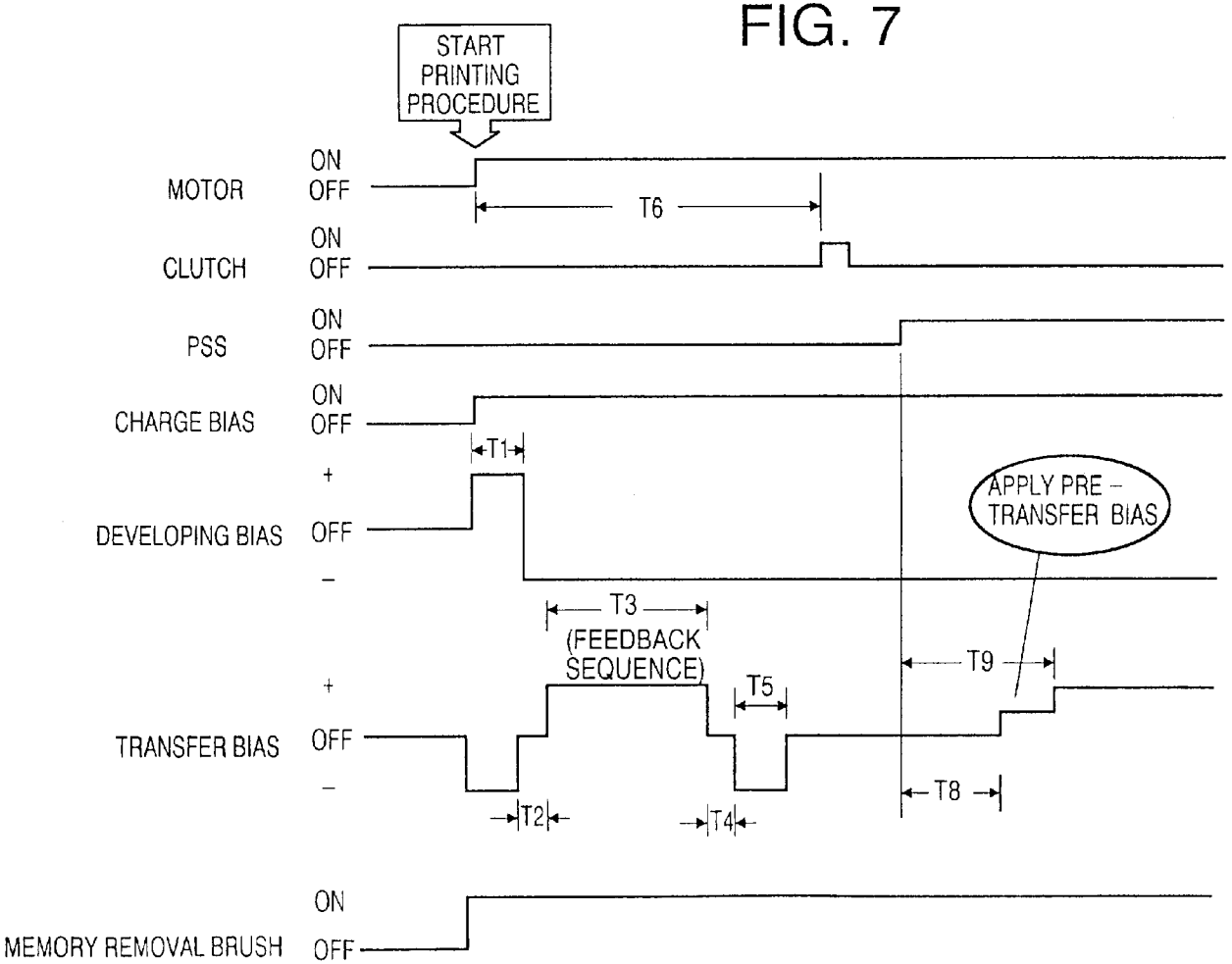
FIG. 7 is a timing chart showing actuation of the cleaner-less image forming apparatus of FIG. 1.

Next, a printing procedure of the cleaner-less image forming apparatus will be described with reference to the flowcharts of FIGS. 4 to 6 and the timing chart of FIG. 7. Timers T1, T2, etc. of the flowcharts corresponds to timers T1, T2, etc. of the timing chart. However, timers T7, T10 are not shown in FIG. 7.

Figure 4:
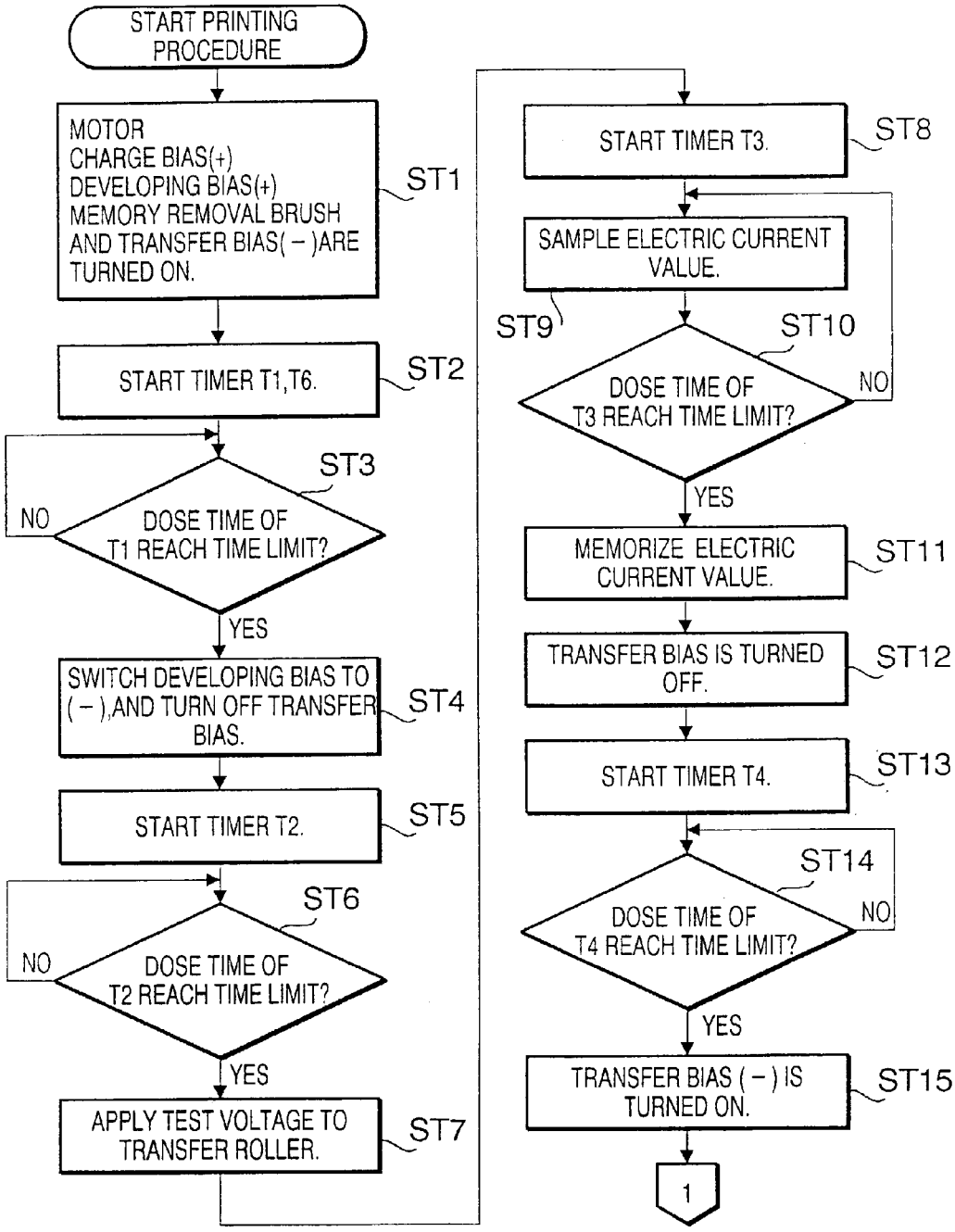
FIG. 4 is a flowchart showing a printing procedure of the cleaner-less image forming apparatus of FIG. 1.

First in the flowchart of FIG. 4, at the time of starting of the printing procedure, the motor 41, the charge bias, the developing bias (+), the memory removal brush 26, and the transfer bias (−) are turned ON in the step ST1. Timers T1, T6 are started in the next step ST2. In the step ST3, it is determined whether or not time of the timer T1 has reached a time limit, and if time of the timer T1 has not reached the time limit, the time limit is awaited.

The developing bias is turned ON with a positive value (+) in order to effectively collect the residual toner which remains on the uncharged part (where the potential is nearly 0V) of the outer circumferential surface of the photoconductive drum 13 by the developer. Moreover, the transfer bias is turned ON with a negative charge (−) in order to collect the toner adhered to the outer circumferential surface of the transfer roller 21 to the outer circumferential surface of the photoconductive drum 13.

When time of the timer T1 reaches the time limit, the developing bias is switched to a negative value (−), and the transfer bias is turned OFF in the step ST4. Subsequently, the timer T2 is started in the step ST5. When time of the timer T2 reaches a time limit in the step ST6, a test voltage is applied to the transfer roller 21 in the step ST7, and the timer T3 is started in the step ST8. Next, sampling of an electric current value is carried out in the step ST9 by detecting an electric current value of the transfer roller 21 by using the current detector 35. Whether or not time of the timer T3 has reached a time limit is determined in the step ST10, and if time of the timer T3 has not reached the time limit, the sampling of a current value is continued. When time of the timer T3 reaches the time limit, the sampled current value is memorized in the feedback current value memorizing part 12*a* of the printer controller 12 in the step ST 11. At this time, the average of the current values obtained by carrying out sampling plural times can be memorized in the feedback current value memorizing part 12*a*.

After that, the transfer bias is turned OFF in the step ST12, and the timer T4 is started in the step ST 13. Whether or not time of the timer T4 has reached a time limit is determined in the step ST 14. When time of the timer T4 reaches the time limit, a negative transfer bias (−) is turned ON in the step ST15. Next, the timer T5 is started in the step ST16, and it is determined whether or not time of the timer T5 has reached a time limit in the step ST17. When time of the timer T5 reaches the time limit, the transfer bias is turned OFF in the step ST18.

In the step ST19, it is determined whether or not time of the timer T6 has reached a time limit. When time of the timer T6 reaches the time limit, it is determined in the step ST20 whether or not heat-up of the fixing unit (the heat roller 23 and the press roller 25) is completed, and if the heating is not completed, the heat-up of the fixing unit is continued. When the heating of the fixing unit is completed, the paper feeding clutch 42 is turned ON in the step ST21. In other words, the pick-up roller 40 is connected to the motor 41 to rotate the pick-up roller 40, and thereby a sheet of paper is picked up from the paper cassette 45 by the pick-up roller 40.

Next, the timer T7 is started in the step ST22, and it is determined in the step ST23 whether or not the PSS 30 is turned ON, i.e., whether or not the sheet has been delivered from the paper cassette 45. If the PSS 30 remains turned OFF, it is determined whether or not time of the timer T7 has reached a time limit in the step ST24. If time of the timer T7 has not reached the lime limit, the process goes back to the step ST23, and it is repeated to determine whether or not the PSS 30 is turned ON until time of the timer T7 reaches the time limit.

If time of the timer T7 reaches the time limit before the PSS 30 is turned ON, i.e., the determination of the step ST24 is YES, the paper jam, out-of-paper, etc. are considered to happen because the sheet is not delivered from the paper cassette 45, though the paper feeding clutch 42 is turned ON. Therefore, the motor 41, the charge bias, the developing bias, the transfer bias, the memory removal brush 26, and the fixing unit are all turned OFF in the step ST25. In this case, a condition such as the paper jam or the out-of-paper condition is displayed on a display unit (not shown) of the operation unit 8 in the step ST26, and the printing process is terminated.

On the other hand, if the PSS 30 is turned ON in the step ST23, the process proceeds to the step ST31 because the sheet is delivered from the paper cassette 45. The timers T8, T9, T10 are started in the step ST31, and it is determined whether or not time of the timer T10 has reached a time limit in the step ST32. If it is determined that time of the timer T10 has not reached the time limit, the time limit of the timer T10 is awaited. When time of the timer T10 reaches the time limit, an exposure of image information is started in the step ST33, and it is determined whether or not time of the timer T8 has reached a time limit in the step ST34. Additionally, from the time time of the timer T10 reaches the time limit to the time time of the timer T8 reaches the time limit, the cleaning (cleaning sequence) is carried out in which the residual toner remaining on the outer circumferential surface of the photoconductive drum 13 is being collected and recovered by the developer.

When time of the timer T8 reaches the time limit, a suitable LUT is selected from the look up table (LUT) group 12*b* (refer to FIG. 8) of the printer controller 12, based on a current temperature acquired by the temperature sensor 37 and the current number of sheets of paper which have been printed, in the step ST35. The current number of sheets which have been printed is memorized in the RAM 5. Subsequently, in the step ST 36, a pre-transfer bias is determined by applying the electric current value memorized in the feedback current value memorizing part 12*a* to the selected LUT, and the determined pre-transfer bias is started to be applied to the transfer roller 21 in the step ST37. In the step ST38, the pre-transfer bias is applied to the transfer roller 21.

While the pre-transfer bias is being applied, potential of the outer circumferential surface of the photoconductive drum 13 contacting with the transfer roller 21 increases, so that the toner adhered to the memory removal brush 26 and the charge brush 14 returns to the outer circumferential surface of the photoconductive drum 13. As a result, it is possible to prevent the decreasing in the function of the memory removal brush 26 and the charge brush 14 which is caused by the toner adhered thereof In addition, such toner is collected and recovered by the developer.

In the step ST39, it is determined whether or not time of the timer T9 has reached a time limit. When time of the timer T9 reaches the time limit, a transfer bias is determined based on the electric current value memorized in the feedback current value memorizing part 12*a* and a temperature acquired by the temperature sensor 37, in the step ST40. In the next step ST41, the determined transfer bias (+) is applied to the transfer roller 21. After that, the printing process is continued.

Figure 9:
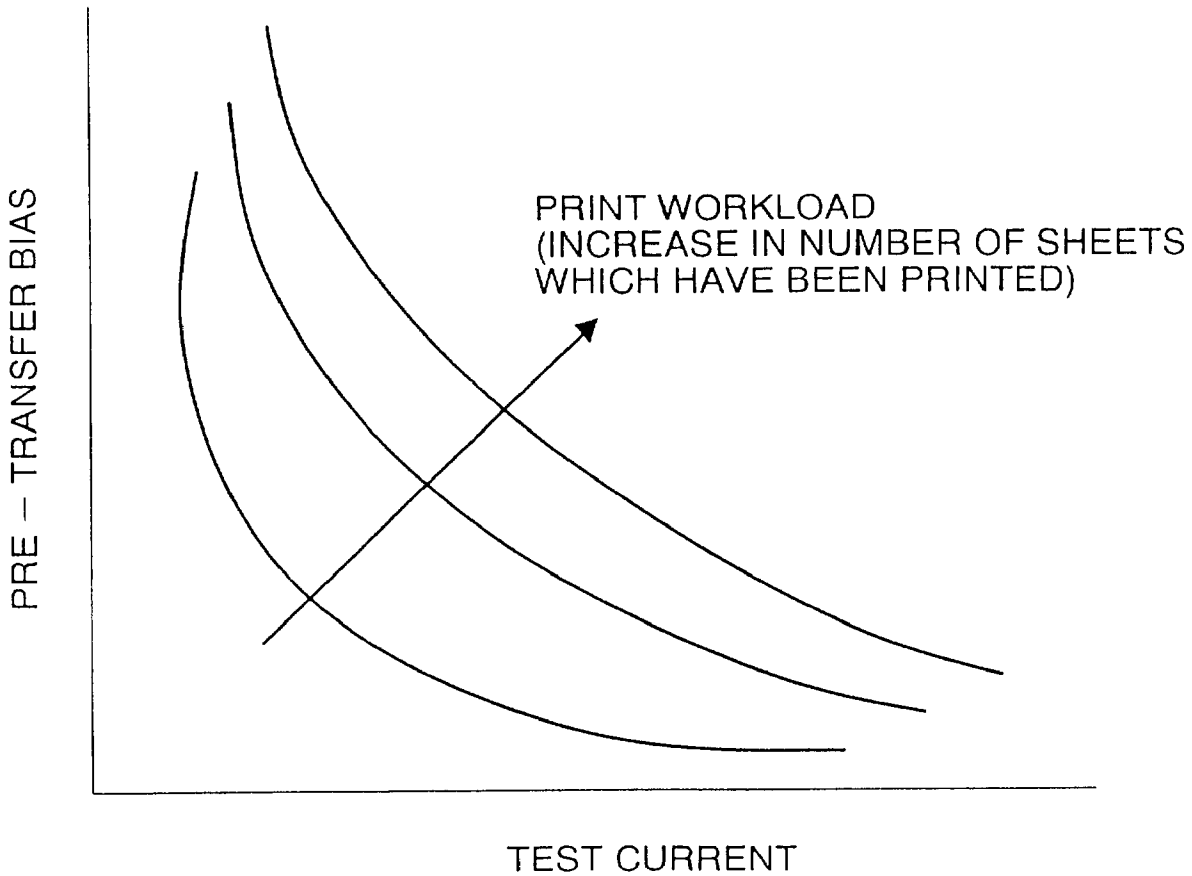
FIG. 9 is a view showing the relation, within a predetermined temperature range, between an electric current when a test voltage is applied and a pre-transfer bias to be applied to a transfer member of the image forming apparatus of FIG. 1.

According to the printing process of the embodiment of the present invention, after the PSS 30 is turned ON, the pre-transfer bias is being applied to the transfer roller 21 until a sheet of paper comes to the transfer position (i.e., the pre-transfer bias is being applied within an interval which is a period from the time a sheet of paper passes the transfer roller 21 to the time the next sheet reaches the transfer roller). This pre-transfer bias is changed in accordance with the number of sheets of paper which have been printed in order to improve cleaning efficiency. In short, as in FIG. 9 showing the relation, within a predetermined temperature range, between a pre-transfer bias and an electric current at the time of applying the test voltage, the more the number of sheets of paper which have been printed becomes, the higher the pre-transfer bias becomes. In other words, the pre-transfer bias is raised in the latter half of the life span of the photoconductive drum 13 so as to enhance the ability in returning the toner from the transfer roller 21, the charge brush 14, and the memory removal brush 26, and to maintain a high quality image for a long term.

Figure 10:
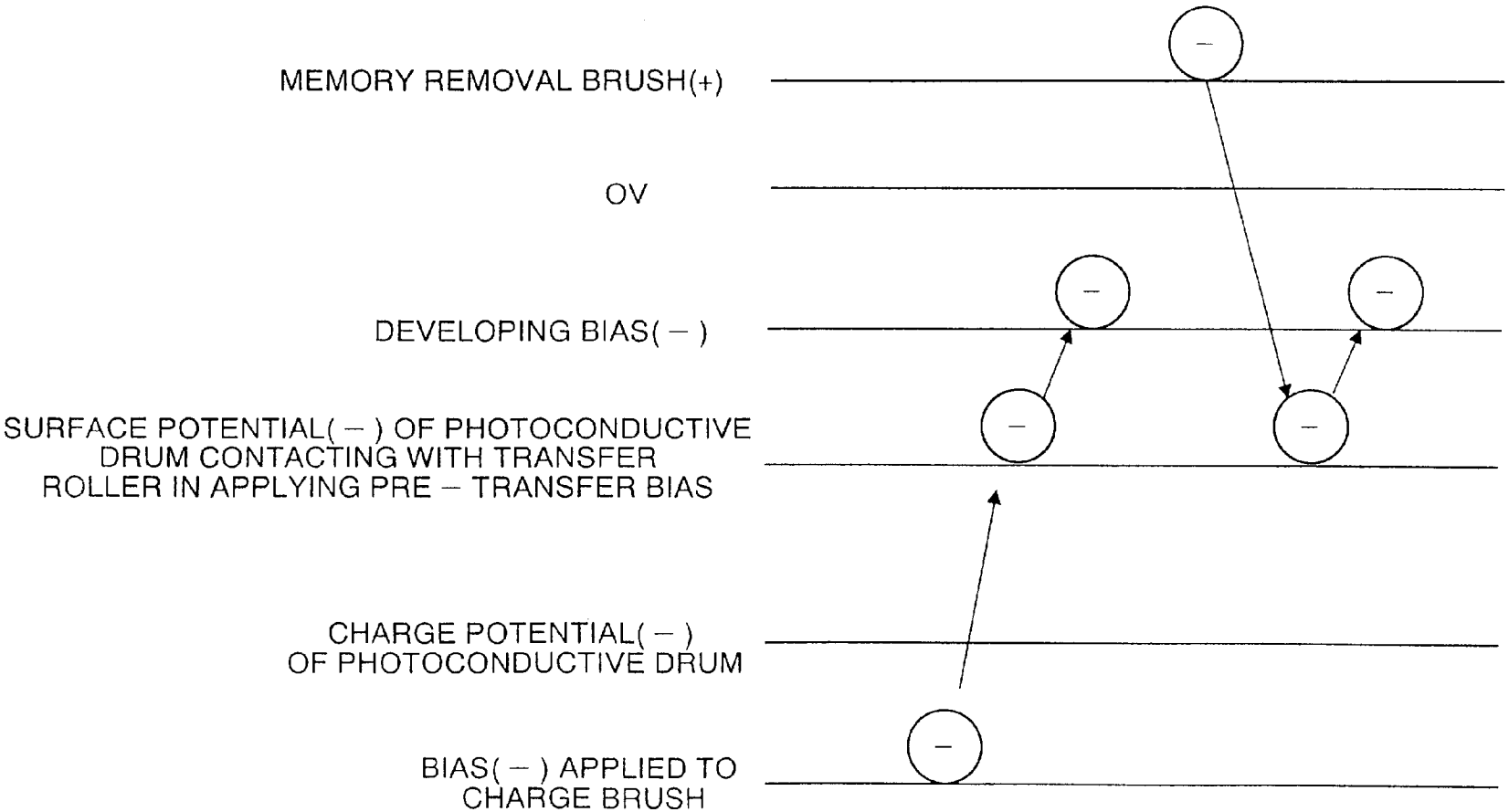
FIG. 10 is a potential chart illustrating movements of toner while the pre-transfer bias is being applied to the transfer member of the cleaner-less image forming apparatus of FIG. 1.

Here, movements of the toner during a period for which the pre-transfer bias is being applied will be described with reference to a potential chart of FIG. 10. In FIG. 10, the upper side has positive potential, and the lower side has negative potential. When the transfer roller 21 contacts with the photoconductive drum 13 in applying the pre-transfer bias, the surface potential of the photoconductive drum 13 becomes higher, remaining negative (−). The toner of the charge brush 14 has negative potential which is more negative than that of the surface of the photoconductive drum 13, so that the toner of the charge brush 14 is attracted to the photoconductive drum, is pulled from the photoconductive drum 13 to the developing bias (−) which is higher than the potential of the photoconductive body which became higher, and is collected and recovered by the developer. In this state, on the other hand, the toner of the memory removal brush 26 remains adhered to the memory removal brush 26 having positive potential (+), but the mechanical force is stronger than the electrostatic force. Therefore, the toner of the memory removal brush 26 is adhered to the photoconductive drum 13 whose surface potential is negative (−), and then the toner is attracted to the developing bias (−), and is recovered by the developer. Also in this period, the photoconductive drum is rotating.

In this manner, the residual toner remaining on the charge brush 14 and the memory removal brush 26, etc. is ultimately collected and recovered by the developer, cleaning efficiency is prevented from reducing, and high print quality is maintained.

Furthermore, the above-described embodiment of the present invention can also be changed as follows.

(1) In the above embodiment of the present invention, a pre-transfer bias is changed in accordance with the number of sheets of paper which have been printed, but a period of time for which a pre-transfer bias is being applied can also be changed in accordance with the number of sheets of paper which have been printed.

(2) In the above embodiment of the present invention, a pre-transfer bias is changed in accordance with the number of sheets of paper which have been printed by the drum unit, but a transfer bias can also be changed in accordance with a period of time for which the drum unit is installed, or a period of time for which the drum unit has been being worked.

(3) In the above embodiment of the present invention, the lookup table is adopted in order to determine a pre-transfer bias, but a function or a map can also be used instead of the lookup table. In this case, a plurality of functions may be prepared, and a suitable function may be selected from them in accordance with the print workload or the number of sheets of paper which have been printed, and in accordance with the surrounding condition.

(4) In the above embodiment of the present invention, the transfer roller as a transfer member is adopted, but a brush, a brush roller, a blade, etc. are also available as a transfer member. Moreover, the charge member is a brush roller, but a roller, a brush, a blade, etc. can also be used as a charge member. In addition to that, the memory removal member is not limited to a brush type.

(5) In the above embodiment of the present invention, a temperature as a surrounding condition is adopted, but humidity can also be adopted as a surrounding condition instead of or together with a temperature. Alternatively, a pre-transfer bias can also be determined based on only an electric current that is detected at the feedback sequence without using the surrounding condition.

(6) In the above embodiment of the present invention, constant-voltage control is performed when applying the pre-transfer bias, but constant-current control can also be performed.

The invention claimed is:

1. An image forming device, comprising:

an image forming apparatus;

a controller, coupled to the image forming apparatus, that determines a preliminary transfer bias that changes according to a print workload that the image forming apparatus has experienced; and a transfer member which is disposed so as to contact with a photoconductive body, wherein the transfer member transfers a toner image on the photoconductive body to a sheet of paper, wherein the preliminary transfer bias is preliminarily applied to the transfer member before a transfer bias is applied to the transfer member, and wherein the preliminary transfer bias increases as the print workload increases.

2. The image forming device according to claim 1, wherein the preliminary transfer bias is applied to the transfer member within an interval which is a period from the time a sheet of paper passes the transfer member to the time a next sheet of paper reaches the transfer member.

3. The image forming device according to claim 1, wherein the preliminary transfer bias is determined before printing takes place.

4. An image forming device, comprising:

an image forming apparatus;

a controller, coupled to the image forming apparatus, that determines a preliminary transfer bias that changes according to a print workload that the image forming apparatus has experienced; and a transfer member which is disposed so as to contact with a photoconductive body, wherein the transfer member transfers a toner image on the photoconductive body to a sheet of paper, wherein the preliminary transfer bias is preliminarily applied to the transfer member before a transfer bias is applied to the transfer member for a period of at least one revolution of the photoconductive body.

5. An image forming device, comprising:

an image forming apparatus;

a controller, coupled to the image forming apparatus, that determines a preliminary transfer bias that changes according to a print workload that the image forming apparatus has experienced;

a transfer member which is disposed so as to contact with a photoconductive body, wherein the transfer member transfers a toner image on the photoconductive body to a sheet of paper, wherein the preliminary transfer bias is preliminarily applied to the transfer member before a transfer bias is applied to the transfer member;

a charging member that charges a surface of the photoconductive body; and a memory removal member for dispersing toner remaining on the photoconductive body.

6. The image forming device according to claim 5, further including:

a developer that supplies toner having a negative charge to the photoconductive body and recovering residual toner;

a transfer bias applying circuit that applies the preliminary bias and the transfer bias to the transfer member;

a first bias applying circuit that applies a first bias to the charging member;

a second bias applying circuit that applies a second bias to the memory removal member; and a third bias applying circuit that applies a third bias to the developer, wherein while the preliminary bias is being applied to the transfer member, the photoconductive body is rotating, potential of the photoconductive body is raised and negative by contacting with the transfer member, the charging member, the memory removal member, and the developer have a potential state by the first, second, and third biases respectively applied by the first, second, third bias applying circuits, and said potential state is a state in which potential of the memory removal member is positive, potential of the charging member is negative and lower than the raised potential of the photoconductive body, and potential of the developer is negative and higher than the raised potential of the photoconductive body, wherein the residual toner of the memory removal member is moved to the photoconductive body by a mechanical force, wherein the charging member and the developer are in contact with the photoconductive body such that the said potential state is maintained, whereby the residential toner having the negative charge of the charging member, the memory removal member, and the photoconductive body is recovered by the developer.

7. An image forming device, comprising:

an image forming apparatus;

a controller, coupled to the image forming apparatus, that determines a preliminary transfer bias that changes according to a print workload that the image forming apparatus has experienced;

wherein the controller determines, the preliminary transfer bias based on a selected lookup table that corresponds to a given print workload, further comprising:

a transfer bias applying circuit for applying the preliminary transfer bias and a test voltage to the transfer member;

a current detector for, before determining the preliminary transfer bias, detecting an electric current value when the test voltage is applied to the transfer member; and a feedback current memorizing part for memorizing the detected electric current value, wherein the controller determines the preliminary transfer bias by applying the electric current value memorized in the feedback current memorizing part to the selected lookup table.

8. An image forming device, comprising:

an image forming apparatus;

a controller, coupled to the image forming apparatus, that determines a preliminary transfer bias that changes according to a print workload that the image forming apparatus has experienced;

wherein the print workload is the number of sheets of paper which have been printed by the image forming apparatus.

9. The image forming device according to claim 8, wherein a value of the preliminary transfer bias is increased as said number of sheets of paper which have been printed increases.

10. An image forming device, comprising:

an image forming apparatus;

a controller, coupled to the image forming apparatus, that determines a preliminary transfer bias that changes according to a print workload that the image forming apparatus has experienced;

wherein the print workload is an accumulated period of time for which the photoconductive body has been operated.

11. The image forming device according to claim 10, wherein a value of the preliminary transfer bias is increased as the accumulated period of time for which the photoconductive body has been operated increases.

12. An image forming device, comprising:

an image forming apparatus;

a controller, coupled to the image forming apparatus, that determines a preliminary transfer bias that changes according to a print workload that the image forming apparatus has experienced; and means for obtaining a value of a surrounding condition;

wherein the preliminary transfer bias is determined based on print workload and the value of the surrounding condition.

13. An image forming device, comprising:

an image forming apparatus;

a controller, coupled to the image forming apparatus, that determines a preliminary transfer bias that changes according to a print workload that the image forming apparatus has experienced;

wherein the preliminary transfer bias increases with a time which the photoconductive body has been in use or the number of uses of the photoconductive body.

* * * * *